United States Patent [19]

Phillips et al.

[11] Patent Number: 4,970,889

[45] Date of Patent: Nov. 20, 1990

[54] CRIMPING MACHINE HAVING IMPROVED ADJUSTING SYSTEM

[75] Inventors: Howard C. Phillips, Harrisburg; Dallas E. Schlegel, Mechanicsburg, both of Pa.

[73] Assignee: AMP Incorporated, Harrisburg, Pa.

[21] Appl. No.: 351,679

[22] Filed: May 12, 1989

[51] Int. Cl.[5] ..... B21J 13/02

[52] U.S. Cl. ..... 72/446; 72/441; 72/482; 29/748

[58] Field of Search ..... 72/441, 446, 413, 482, 72/472, 234; 29/750, 748

[56] References Cited

U.S. PATENT DOCUMENTS

| | | | |
|---|---|---|---|
| 558,673 | 4/1896 | Colling | 72/413 |
| 2,792,044 | 5/1957 | Strom | 72/413 |
| 3,184,950 | 5/1965 | Sitz | 72/412 |
| 3,948,077 | 4/1976 | Bothe | 72/441 |
| 4,130,005 | 12/1978 | Haines | 72/441 |
| 4,611,484 | 9/1986 | Mac Kissinger, Jr. | 72/481 |
| 4,791,803 | 12/1988 | Broquet et al. | 72/472 |

OTHER PUBLICATIONS

AMP Customer Manual, CM 5128, Dec. 1984, "Basic AMP-O-Lectric Model 'K' Terminating Machine, Accessories, and Modified Machines".

*Primary Examiner*—David Jones

[57] ABSTRACT

Crimping machine comprises a press and a terminal applicator. The applicator ram is coupled to the press ram and has movable crimping tooling adjustably mounted thereon. The fixed crimping tooling is mounted in the applicator frame which in turn is supported on the press platen. A coarse adjusting system is provided on the applicator ram for adjusting the position of the movable crimping tooling on the ram and a fine adjusting system is provided in the press platen for adjusting the position of the applicator frame and thereby adjusting the position of the fixed tooling. The fine adjusting system results in the achievement of crimped connections within more narrow tolerance limits than have heretofore been possible.

11 Claims, No Drawings

CRIMPING MACHINE HAVING IMPROVED ADJUSTING SYSTEM

FIELD OF THE INVENTION

This invention relates to machines for crimping electrical terminals onto wires and particularly to improved adjusting systems for such machines for adjusting the shut height of movable crimping tooling (the crimping die) relative to the fixed crimping tooling (the crimping anvil).

BACKGROUND OF THE INVENTION

The most commonly used type of crimping apparatus comprises a press having a press frame, a press bed or platen, and a reciprocable ram which is movable towards and away from the press platen. Fixed crimping tooling is mounted on the press platen and movable crimping tooling is secured to the ram so that if an uncrimped terminal is placed on the fixed tooling and the wire is positioned in the terminal, the terminal will be crimped onto the wire when the ram moves towards the platen to its shut height position, that is, to the lower-most position of the stroke. Usually, a terminal applicator is used which has an applicator frame and an applicator ram. The applicator frame is supported on the press platen and the fixed tooling is mounted on the applicator frame rather than directly on the press platen. Also, the movable tooling is mounted on the applicator ram and the applicator ram is coupled to the press ram. Applicators of this type usually are provided with a self-contained terminal feeding mechanism for feeding terminals in strip form to the fixed crimping tooling. It is also common to provide an adjusting means on the applicator ram for adjustably moving the movable tooling on the ram in the directions of reciprocation so that the shut height position of the tooling can be adjusted for a particular terminal size and wire size combination.

In order for a crimped connection between a particular terminal and wire to perform satisfactorily, it is necessary that the "crimp height" of the crimped connection be closely controlled. The crimp height is the overall height of the crimped connection, usually between the base of the terminal ferrule and the top of the crimped portion. The crimp height is specified as a nominal crimp height, plus or minus a tolerance; for example, the specification for a particular terminal and a particular wire might require a crimp height of 0.060 inches ± 0.002 inches (1.52 mm ± 0.051 mm). A crimped connection having a crimp height of 0.057 inches (1.45 mm) or 0.063 inches (1.60 mm) would not satisfy the specification and would not be regarded as a satisfactory crimped connection. The crimping operation thus requires a relatively high degree of exactitude to satisfy the current industry standards and presently available adjusting systems on crimping machines are sometimes incapable of doing so. Terminal applicators of the type briefly described above, if properly adjusted and calibrated and if they are placed in a properly adjusted and maintained press, are capable of producing crimped connections within the standard tolerances of ±0.002 inches (0.051 mm) of a nominal crimp height. However, if the applicator is placed in a press which is not properly adjusted or if the applicator itself has not been recently inspected, adjusted, and calibrated, out-of-tolerance crimp connections will frequently be produced and the quality of the crimped connections produced in the particular applicator-press combination will suffer.

Another problem which is being faced to an increasing extent by manufacturers of electrical terminals has resulted from the fact that some industries are demanding tighter or closer tolerances in their crimp connections than the ±0.002 inches (0.051 mm) noted above. In an increasing number of instances, the users of crimped electrical connections are demanding a tolerance range of only 0.001 inch and existing crimping machines are usually incapable of achieving this high degree of exactitude in the terminals crimped.

The present invention is directed to the achievement of an improved crimping machine having an adjusting system which permits the achievement of crimped connections which are consistently within a very narrow tolerance range and which will satisfy the most exacting requirements of the industry.

THE INVENTION

The invention comprises a terminal crimping machine for crimping electrical terminals onto the ends of wires, the resulting crimped connections being required to have a predetermined nominal crimp height plus or minus a predetermined crimp height tolerance. The crimping machine comprises a ram means having movable crimping tooling thereon, a fixed tooling support means having fixed tooling thereon, the ram being reciprocable in opposite directions of reciprocation towards and away from the fixed tooling thereby to move the movable tooling between a remote position and a proximate position with respect to the fixed tooling. The movable tooling is in a shut height position when it is in its proximate position and the shut height position determines the crimp height of the crimped connection. The crimping machine is characterized in that a fine adjusting means is provided for moving the fixed tooling for adjustment purposes in the directions of reciprocation, the fine adjusting means having an adjustment sensitivity which is commensurate with the crimp height tolerance. The fine adjusting means is in the fixed tooling support means and comprises an adjusting screw and a wedge block means whereby the position of the fixed tooling can be adjusted relative to the shut height position of the movable tooling thereby to produce crimped connections having a crimp height which is within the predetermined tolerance. In one embodiment, a terminal applicator is provided having an applicator frame and an applicator ram, the applicator ram being coupled to the press ram. A coarse adjusting means is provided on the applicator ram for adjusting the position of the movable tooling.

In one embodiment, the fine adjusting means comprises support means on the platen of the press, adjusting screw means, and inclined wedge block means. The applicator frame is on the support means and the adjusting screw means and the inclined wedge means are effective, upon rotation of the adjusting screw means, to move the support means and the applicator frame in the opposite directions of reciprocation. In the herein disclosed embodiment, the adjusting screw means extends transversely of the directions of reciprocation.

THE DRAWING FIGURES

FIG. 6 is a view looking in the direction of the arrows 6—6 of FIG. 5.

FIG. 7 is a perspective view showing an uncrimped terminal and a stripped wire.

FIG. 8 is a view showing the terminal crimped onto the end of the wire.

THE DISCLOSED EMBODIMENT

Figure 1:
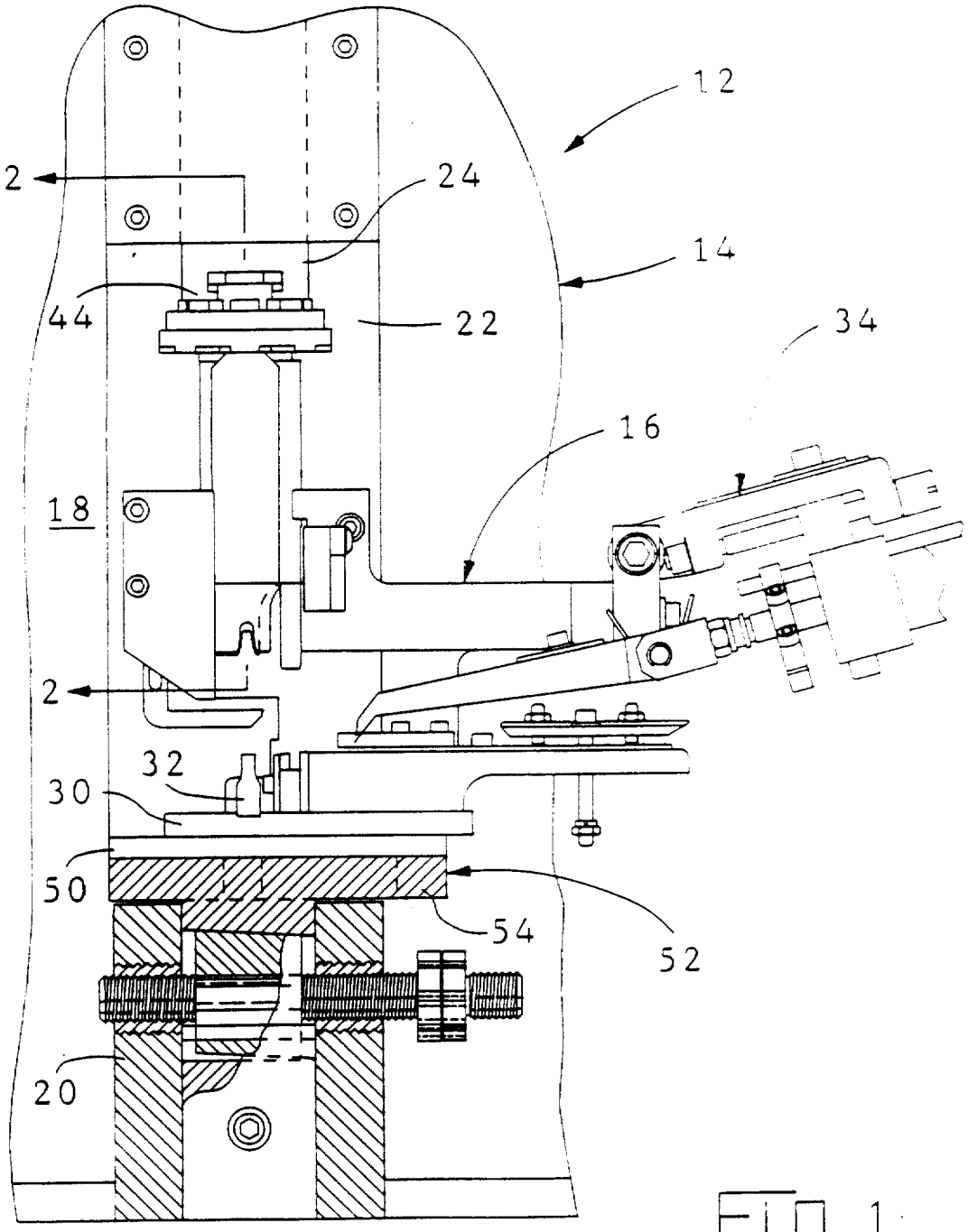
FIG. 1 is a frontal view, partially in section, of a crimping machine having an adjusting system in accordance with the invention.

FIG. 8 shows a crimped connection 2 of a terminal 4 onto the stripped end 6 of a wire. The terminal has a base 8 and parallel side walls 10 which, upon crimping, are bent inwardly towards each other and downwardly towards the base so that in the finished crimped connection, the wire strands are surrounded and compressed by the crimped ferrule.

The distance between the base 10 and the upper surfaces of the inwardly formed side walls is generally referred to as the crimp height C and is a very critical dimension. This dimension is customarily specified as a nominal crimp height plus or minus a tolerance t. For example, the crimp height of a particular wire and terminal combination may be 0.06 inches (1.52 mm) ± some predetermined tolerance. Increasingly, it is required that the tolerance be no more than ± 0.001 inch (0.025 mm) for a crimped connection having a nominal crimp height of, for example, 0.06 inches (1.52 mm). These relatively close tolerances in crimped connections can readily be achieved if the crimping machine is equipped with an adjusting system as described below.

The crimping machine 12 comprises a conventional press 14 and a terminal applicator 16. The press has a press frame 18 having upper and lower arms 22, 20 and a reciprocable press ram 24 in the upper arm. The lower arm is the press bed or platen and supports the applicator 16 as will be described below.

The applicator 16 comprises an applicator frame 26 having a reciprocable applicator ram 28 therein and a base 30 on which the lower, or fixed, crimping tooling 32 is mounted. A terminal feed mechanism 34 is provided for feeding terminals in strip form to the fixed crimping tooling. The terminals ordinarily will have one ferrule portion which is crimped onto the stripped ends of a wire as shown in FIG. 1 and a second ferrule portion (not shown) which is crimped onto the insulation of the wire. The present invention is concerned primarily with the crimping of the wire barrel portion of the terminal onto the wire since the insulation crimp is not critical and does not affect the electrical characteristics of the crimped connection.

The applicator ram has movable tooling in the form of crimpers or crimping dies 36, 38 adjustably mounted thereon for crimping the two portions of a terminal onto the stripped wire end and the insulation of the wire. The upper end 40 of the applicator ram is coupled to the lower end of the press ram by an adapter 42 which receives inwardly directed arms on the end of the press ram as shown at 44. Dials 46, 48 are provided on the upper end of the applicator ram for moving the two crimping dies 36, 38 for adjustment purposes. The dial 48 for the crimper 36 which crimps the terminal onto the wire thus serves as a coarse adjusting means in that it determines the position of the crimping die 36 on the ram and thereby determines the shut height position of the crimping die 36 with respect to the fixed crimping tooling. This coarse adjusting means is augmented by a fine adjusting means which is described below.

Figure 2:
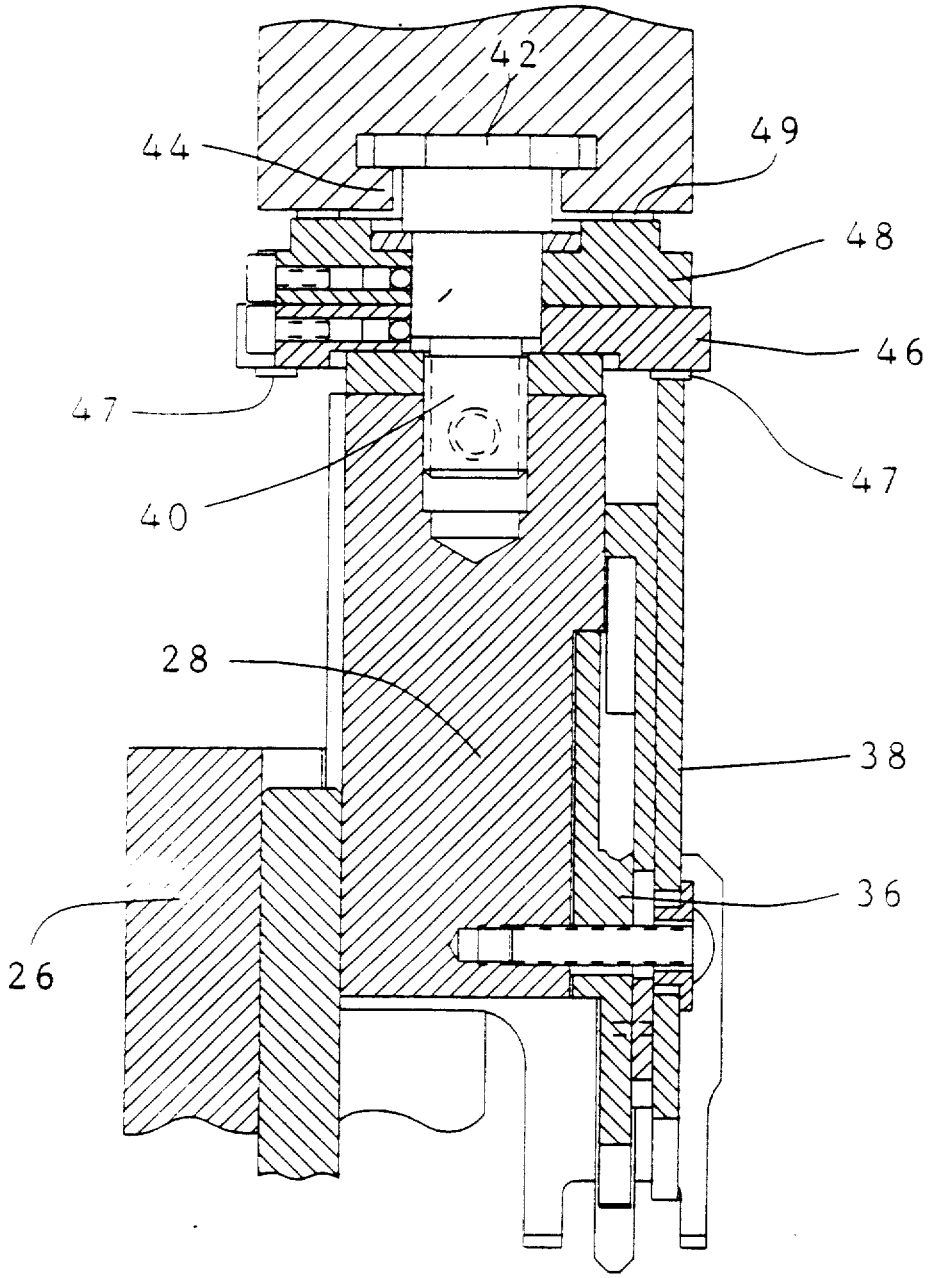
FIG. 2 is a sectional side view of the upper portion of the applicator looking in the direction of the arrows 2—2 of FIG. 1.
Figure 3:
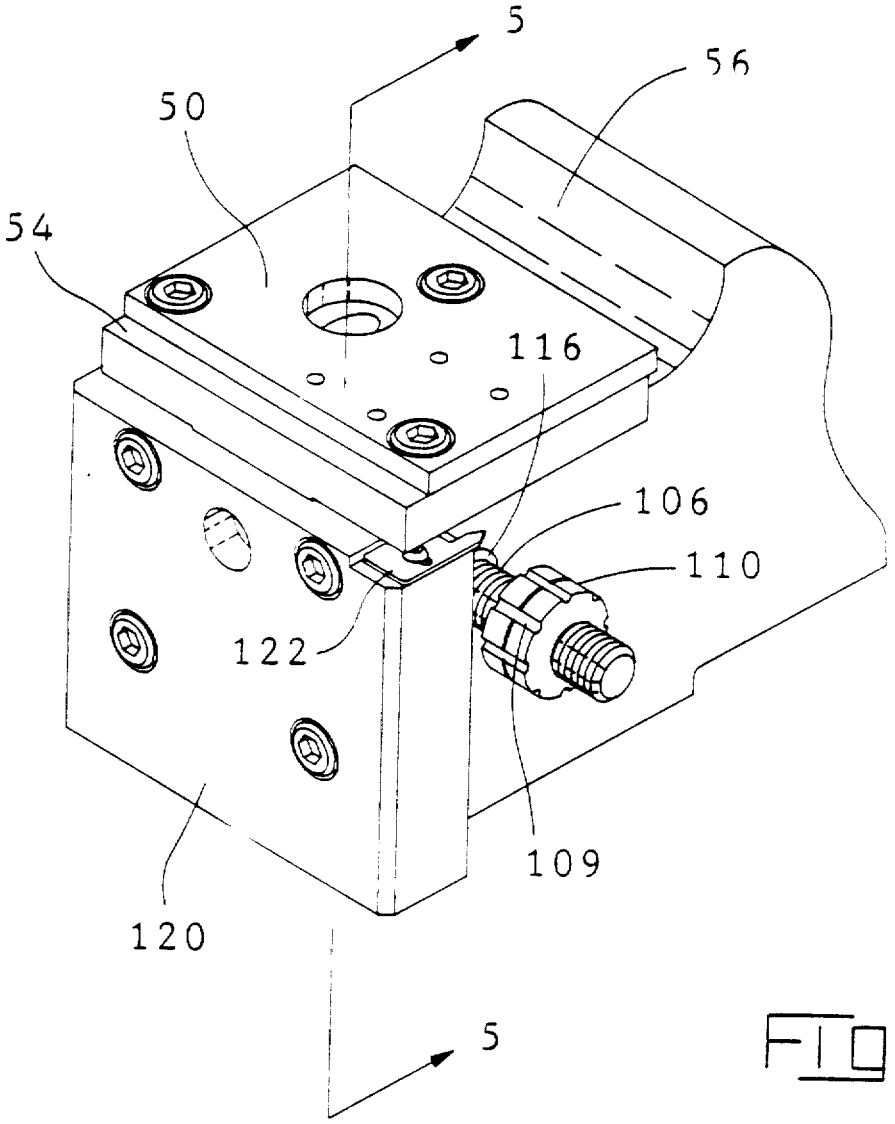
FIG. 3 is a fragmentary view of the press bed or platen having the adjusting means assembled thereto.

As shown in FIG. 2, the crimping die 38 is loosely carried on the applicator ram 28 and its position is adjusted by the bosses 47 on the underside of dial 46. The dial 48 has bosses 49 on its upper surface which are of varying heights. The bosses 49 are between the surfaces of the inwardly turned end of the press ram and the upper surface of the dial. Dial 48 is coupled to the applicator ram by the adaptor 42 so that the shut height of the crimping die 38 depends upon the height of the particular boss which is interposed between the press ram and the applicator ram.

U.S. Pat. Nos. 3,184,950 and 4,611,484 show additional details of an applicator of the type shown in the instant drawing and the manner in which the applicator can be mounted on a crimping press. These patents are incorporated herein by reference.

The fine adjusting means 52 for making exacting adjustments to the shut height position of the crimping die 36 comprises a plate 54 which supports the mounting plate 50 on which the base 30 of the applicator is in turn mounted. The plate 54 is opposed to, and movable with respect to, the top surface 56 of the lower arm or platen of the press frame, see FIG. 4. The plate 54 has a downwardly extending arm 58 which is received in a recess 60 that extends inwardly from the front surface 66 of the lower arm. This recess has an inner vertical wall 62 and opposed side walls 64 which extend to the front surface. The downwardly projecting arm 58 has a channel-like recess 62 in its rearwardly facing surface as viewed in FIG. 5 and this recess 68 has upper and lower side walls 70, 72 which are parallel to each other and which are inclined downwardly as viewed in FIG. 6 from left to right. The angle of inclination is quite small, about three degrees or so. The lower portion 74 of the depending arm 58 is positioned against the front surface 76 of a fixed block 78 which is contained in the lower portion of the recess 60 and which is held in position by a fastener 80.

Figure 5:
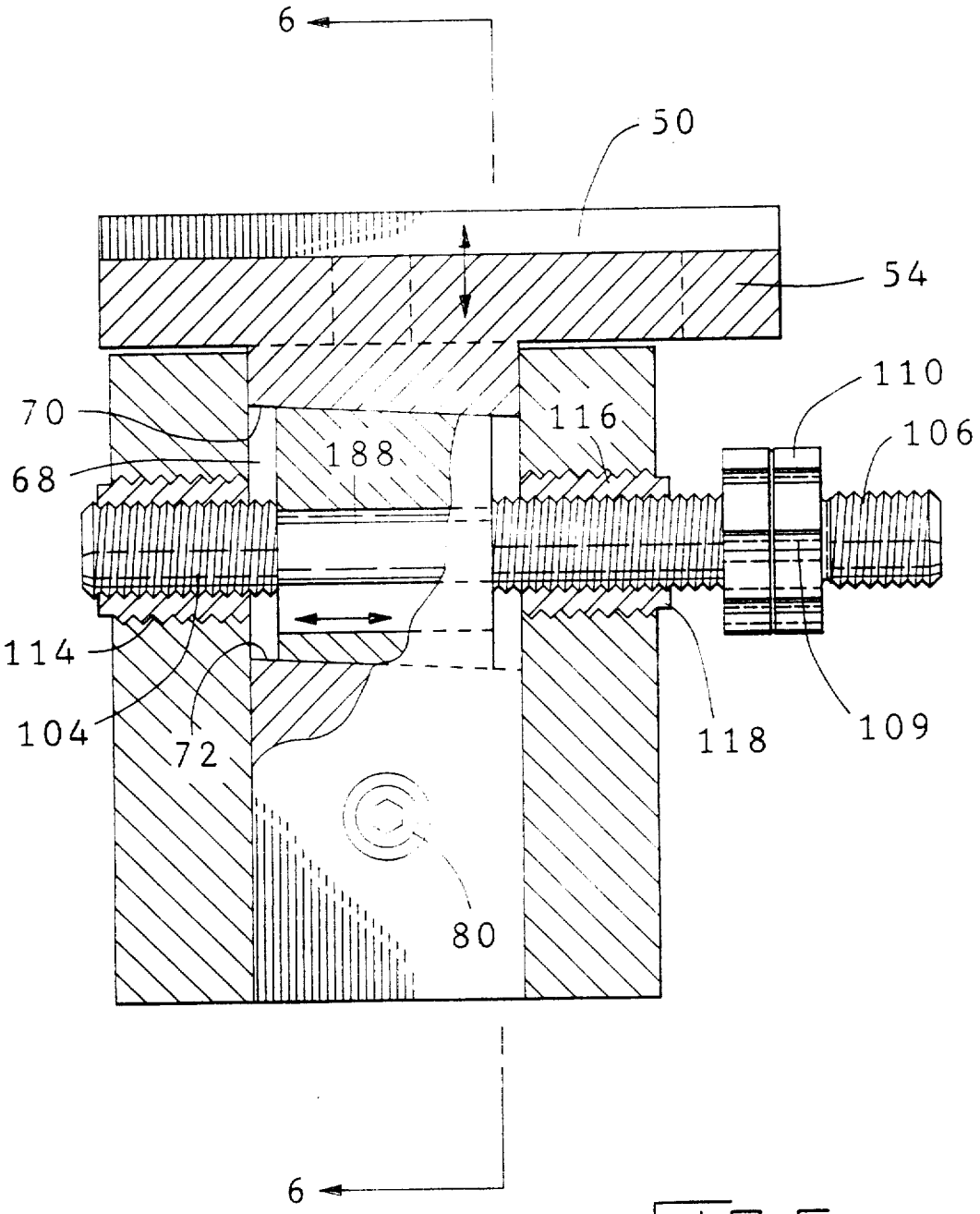
FIG. 5 is a sectional front view looking in the direction of the arrows 5—5 of FIG. 3.

The plate 54 and the depending arm 58 are movable vertically as shown in the arrows in FIG. 5 for adjustment purposes by a wedge block 82 having an upper surface 84 which is inclined at the same angle of inclination as that of the side wall 70 of the channel 68. The leftwardly facing surface 86 of this block is disposed against the inner surface of the channel 62 and an arm 88 extends downwardly adjacent to the surface 86. This arm has a narrow bottom surface 90 which is also inclined and which bears against the side wall 72 of the channel 68. As shown in FIG. 6, relatively narrow channels 92, 94 are provided in the rearwardly facing surface of the arm 88 and in the front surface 76 of the block 78 and interfit with each other as shown in FIG. 6. These channels are not inclined but are horizontal. A slot 96 extends transversely through the block 82 and a horizontal flat surface 98 extends from this slot to the rearward surface of the block 82. The surface 98 bears against, and is supported by, the upper surface 100 of the fixed block 78.

It will be apparent from the foregoing that horizontal movement of the wedge block as viewed in FIG. 5 will result in vertical movement in the direction of the arrows of FIG. 5 of the depending arm on the plate 54 and this movement of the plate 54 will adjust the position of the fixed tooling in the applicator ram. It should be mentioned that the applicator frame can be moved independently of the applicator ram for adjustment purposes since the applicator ram is coupled to the press ram and is held in a fixed position if the applicator frame is adjusted in a vertical sense.

The position of the wedge block is adjusted by an adjusting screw 102 having threaded ends 104, 106 and an intermediate unthreaded portion 108. The diameter of the unthreaded portion is less than the width of the recess or slot 96 so that this unthreaded portion is freely received in the recess. The threaded portions bear against the ends of the wedge block, however, and will push the wedge block in either horizontal direction upon rotation of the screw as described below. The threaded ends of the adjusting screw are received in holes 112 which extend from the sides of the lower press frame arm to the vertical recess 60. These holes have coarse threads therein which receive bushings 114, 116 of the type commonly known which may have fine internal threads and relatively coarse external threads. These bushings also have flat surfaces 118 on their ends by means of which they can be turned with a specialized type of wrench.

Figure 4:
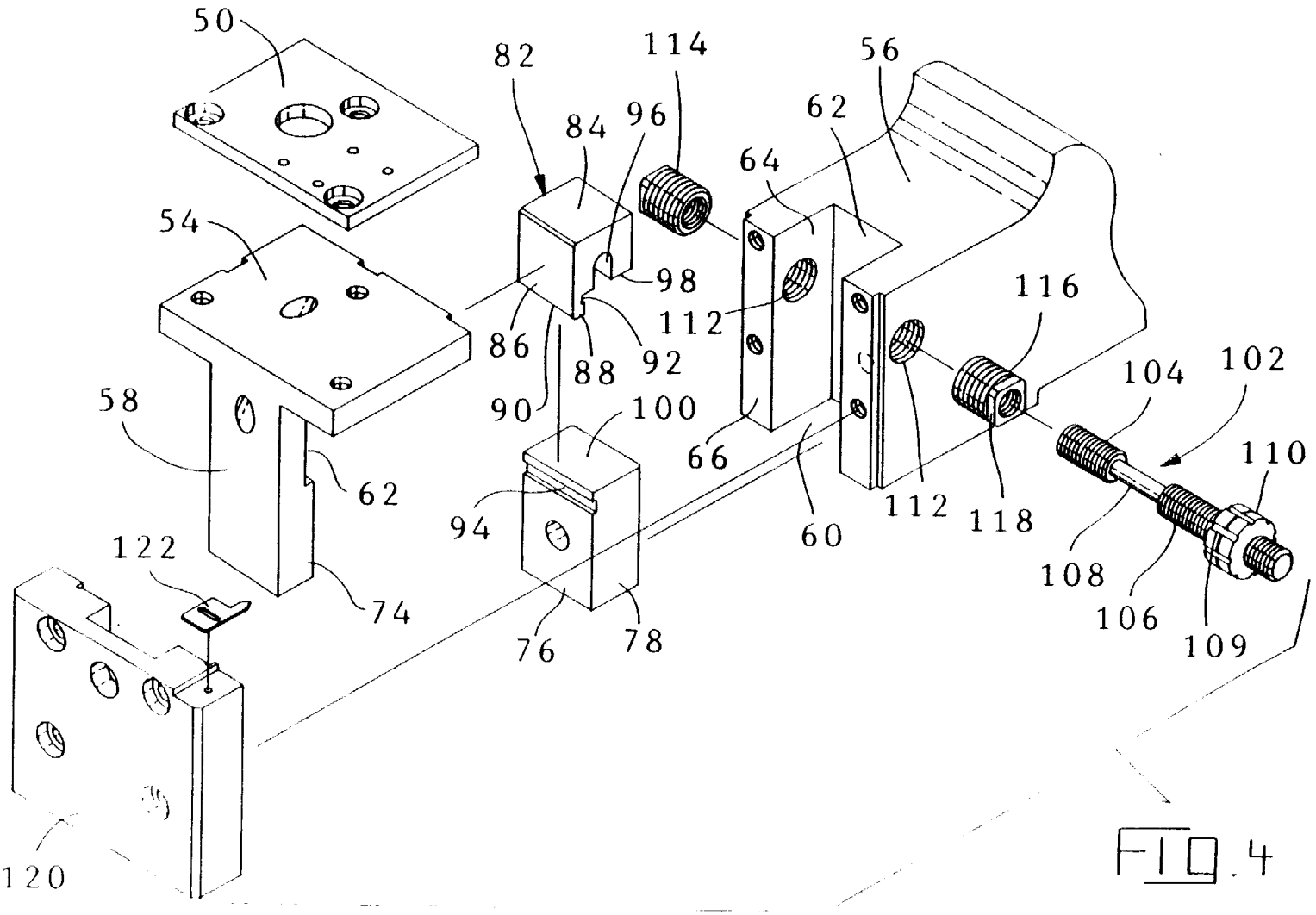
FIG. 4 is a view similar to FIG. 3 but showing the parts exploded from each other.

The parts shown in FIG. 4 are assembled to each other by first placing the bushings 114, 116 in the holes 112 threading the adjusting screw through the bushings until the threaded end 104 is received in the left-hand bushing 114 as shown in FIG. 5. Thereafter, the block 78 is positioned in the opening 60 and secured to the press frame by the fastener 80. The wedge block 82 can then be positioned in the upper portion of recess 60 as shown in FIGS. 5 and 6 and the plate 54 and its depending arm assembled to the lower press arm. Finally, a face plate 120 is secured to the face 66 of the lower press arm by suitable fasteners.

A pointer 122 is fixed to the upper surface of the face plate 120 so that its tip can be sighted with respect to a cylindrical indicator 110 which is fixed to the threaded end 106 of the screw 102. The indicator 110 has markings at equally spaced angular intervals so that a technician can turn the screw by a predetermined amount thereby to bring about the raising or lowering of the plate 54 and the fixed crimping tooling by a predetermined amount. Additionally, a knob can be provided on the end of the threaded portion 106 so that it can be rotated by the technician.

It is desirable to place the adjusting screw 102 in tension as a last step in the assembly process so that there will be no backlash or slack (looseness) in the screw and rotation of the screw will result in immediate movement of the wedge block. The adjusting screw can be placed in tension by holding the bushing 114 against rotation and rotating the bushing 116 in a direction such that the adjusting screw will be stretched by a very slight amount. The adjusting screw is not held in any way when this operation is carried out. The bushings can be held and turned by a slight amount by means of specialized wrenches which are designed to engage the flat surfaces 118 on the ends of the bushing.

As will be apparent from FIG. 6, the compressive forces which are brought about during the crimping operation are not transmitted through the adjusting screw but are transmitted through the wedge block 82 to the block 78. The screw may be stressed to a slight extend because of the fact that the threaded portions 104, 106 bear against the sides of the wedge block but this effect is relatively minor.

The operating procedure which is followed when a technician undertakes to crimp terminals onto a plurality of wires is as follows. The technician first sets the dials to the settings required for the wire size and terminal size of the particular wire and the particular terminal which he is working with. The technician then crimps a single terminal onto a single wire and measures the crimp height of the crimped connection. If the applicator is properly adjusted and in good working order and if the press is likewise properly adjusted and in good working order, the crimp height which is measured should be within the allowable tolerances required for the particular terminal and wire. However, quite often the applicator and press will not be in perfect working order and the technician may find that the measured crimp height is outside of the tolerance limits. The technician will, from his measurements, know the amount by which the crimped connection is outside the tolerance limits and he can then rotate the adjusting screw 102 a number of turns which will raise or lower the fixed crimping tooling by the amount required to produce a crimped connection which is within the tolerance limits. Because of the fact that the fine adjusting system has a high degree of sensitivity, the technician can in fact adjust the position of the fixed tooling to a degree that the crimped connections are very close to the nominal crimp height.

The standards for the threads 104, 106 and the angle of inclination of the sidewalls 70, 72 will determine the relationship between the number of turns of the screw 102 and the vertical movement of the plate 54. In other words, threads and the angle determine the sensitivity of the adjusting system. Since the fine adjusting system is intended to serve as an extremely sensitive system, it is preferable to choose a thread standard and an inclination angle such that the technician using the system can easily move the fixed tooling by amounts of less than 0.001 inches (0.025 mm). For example, the thread standards should be selected such that rotation of the screw 102 by an amount equal to the distance between two adjacent indicator markings 109 translates into vertical adjustment of the plate 54 by about 0.0005 inches (0.013 mm).

The parts should also be designed such that the fine adjusting system will have a range of about 0.018 inches (0.457 mm); in other words, if it is assumed that the wedge block is centrally located as shown in FIG. 6, the system should be designed such that rightward movement of the wedge block to the limit of its range should lower the plate by about 0.009 inches (0.229 mm) and leftward movement should raise the plate by about the same amount so that the total range of adjustment is 0.018 inches (0.457 mm).

The benefits achieved by the practice of the invention can best be understood if a specific, but hypothetical, situation is considered. Assume, for example, that a technician must make some crimped connections between a particular wire and a particular terminal and that the specification for the crimped connection requires a crimp height of 0.061 inches (1.55 mm) $\pm$ 0.002 inches (0.051 mm). The technician will, of course, first set the dials at the positions which should produce satisfactory crimped connections within the nominal tolerance range of the nominal crimp height of 0.061 inches (0.155 mm). If the technician forms a crimp connection and measures the crimped height prior to starting a production process, and if he finds that the actual crimp height is 0.064 inches (1.63 mm), he would be required to make adjustments to the press or the applicator and such adjustments can only be made with great difficulty. For example, a shim might be imposed or removed beneath the mounting plate of the applicator or appropriate shims might be provided in the applicator itself. Some presses are provided with crude adjusting means in the press platen, but these adjusting systems have no indications thereon as to the movement achieved when adjustments are made and the entire process may become a trial and error system which must be carried out with the aid of suitable gauges. If the press is provided with a fine adjusting system in accordance with the present invention, the technician need only rotate the adjusting screw 102 by an amount which will bring the crimped connections into the required tolerance range. Furthermore, the crimp connections can be made to a crimp height which is within extremely close or tight tolerance limits as is being required increasingly by some users of crimp connections. While a tolerance range of ±0.002 inches (0.051 mm) has heretofore been common, many users of crimp connections are now requiring a tolerance range of ±0.001 inch (0.025 mm) and this is entirely possible with an adjusting means in accordance with the invention.

The term "sensitivity," as used herein with respect to the coarse and fine adjusting means described above, refers to the degree of exactitude of the two adjusting means. A specific example will serve to clarify the term.

A representative terminal has a ferrule 4 which can be crimped onto any wire in the range of AWG 16-20. The table below sets forth the crimp heights of the crimped connections for the three wire sizes.

| Wire Size | Crimp Height | Dial Setting on Applicator |
|---|---|---|
| 16 | 0.060 ± 0.002 in. (1.52 ± 0.051 mm) | A |
| 18 | 0.053 ± 0.002 in. (1.35 ± 0.051 mm) | B |
| 20 | 0.049 ± 0.002 in. (1.24 ± 0.051 mm) | C |

The dial 48 on the applicator is not graduated in units of length (inches or millimeters) but with letters for the reason that the dial, the coarse adjusting menas, is not an exacting device capable of adjusting the position of the crimping die to the nearest 0.001 inch (0.025 mm) but it is capable of adjusting the position of the crimping die to the nominal position which will result in the crimping of the terminal to the nominal crimp height. The coarse adjusting means therefore has an adjustment sensitivity which is commensurate with the nominal crimp height. The fine adjusting means is capable of adjusting the position of the crimping die to the nearest 0.001 inch (0.025) and therefore has an adjustment sensitivity which is commensurate with the crimp height tolerance.

The high degree of sensitivity of the fine adjusting means is realized by virtue of the fact that the inclination of the surfaces 84 and 90 of the wedge block 82 is slight, preferably about three degrees. If the wedge block angle is three degrees, it must be moved horizontally a distance of 0.02 inches (0.51 mm) to cause a vertical movement of the plate of 0.001 inch (0.025 mm), a ratio of twenty to one. The threads of the adjusting screw are relatively fine so that a complete revolution of the adjusting screw will cause a linear movement of the wedge block of only about 0.08 inches (2 mm) and vertical movement of the plate 54 of 0.004 inches (0.10 mm). As noted above, rotation of the screw by an amount of the spacing of two adjacent markings 109 causes vertical movement of the plate by only 0.0005 inches (0.013 mm). It is thus an easy task to adjust the shut height of the crimping die to a position such that the crimp height of the crimped connection will be within ±0.001 inch (0.025 mm) of the nominal crimp height.

It will be apparent from the foregoing that the practice of the invention permits the achievement of a significant improvement in crimped connections in that previously accepted dimensional irregularities can be eliminated and the tolerance limits of the crimp heights can be narrowed with an accompanying improvement in electrical performance.

I claim:

1. A terminal crimping machine for crimping electrical terminals onto the ends of wires, the resulting crimped connections being required to have a predetermined nominal crimp height plus or minus a predetermined crimp height tolerance, the crimping machine comprising a press and a terminal applicator, the press comprising a press frame and a press ram, the press frame having a press platen, the applicator comprising an applicator frame and an applicator ram, the applicator frame being supported on the press platen and having fixed crimping tooling thereon, the applicator ram having one end which is coupled to the press ram, the other end of the applicator ram having movable crimping tooling thereon which is movable towards and away from the fixed tooling in opposite directions of reciprocation between a remote position and a proximate position upon reciprocation of the press ram, the movable tooling being in a shut height position when it is in its proximate position, the shut height position determining the crimp height of the crimped connection, the crimping machine being characterized in that:

first and second adjusting means are provided for adjusting the shut height position, the first adjusting means being a coarse adjusting means which is on the applicator ram and which adjusts the position of the movable tooling relative to the fixed tooling, the first adjusting means having an adjustment sensitivity which is commensurate with the nominal crimp height, the second adjusting means being a fine adjusting means having an adjustment sensitivity which is commensurate with the crimp height tolerance, the second adjusting means being on the press platen and being effective to adjust the position of the applicator frame relative to the press platen in the directions of reciprocation, the second adjusting means comprises support means on the press platen, adjusting screw means which extends transversely of the directions of reciprocation, and inclined wedge block means, the applicator frame being on the support means, the adjusting screw means and the inclined wedge block means being effective, upon rotation of the adjusting screw means, to move the support means and the applicator frame in the directions of reciprocation, the wedge block means comprises a wedge block having a first inclined surface, the support means having a second inclined surface which is against the first inclined surface, the first and second inclined surfaces being inclined in a direction which extends transversely of the directions of reciprocation, the press platen has an applicator mounting surface and a recess extending into the applicator mounting surface, the support means having a support extension which extends into the recess, the second inclined surface being on the support extension, the wedge block being in the recess, and the adjusting screw means extending into the press frame to the recess and being in engagement with the wedge block whereby, after setting the first adjusting means at a setting which will produce a predetermined nominal crimp height, the second adjusting means can be set at a setting which will produce a crimped connection having a crimp height which is within the tolerance range.

2. A terminal crimping machine as set forth in claim 1 characterized in that the recess has an inner end and a load bearing surface at its inner end which extends substantially normally of the directions of reciprocation, the wedge block having a bottom surface which faces in the opposite direction from the first inclined surface, the bottom surface being against the load bearing surface whereby during crimping, the crimping forces are transmitted from the fixed tooling through the support means, through the first and second inclined surfaces, and through the bottom surface of the wedge block to the press frame.

3. A terminal crimping machine as set forth in claim 2 characterized in that the adjusting screw means comprises an adjusting screw which has threaded end portions and an unthreaded intermediate portion of reduced diameter, the wedge block having an opening extending therethrough normally of the directions of reciprocation, the intermediate portion being in the opening, the press frame having the threaded holes on each side of the recess which receive the threaded ends of the adjusting screw, the opening in the wedge block being oversized relative to the intermediate portion of the adjusting screw and the adjusting screw having portions which bear against the ends of the wedge block whereby rotation of the adjusting screw causes movement of the wedge block.

4. A terminal crimping machine as set forth in claim 3 characterized in that the adjusting screw is stressed in tension whereby backlash in the adjusting screw is substantially eliminated.

5. A terminal crimping machine as set forth in claim 4 characterized in that the fine adjusting means has a range of adjustment which is greater than the tolerance range of the nominal crimp height.

6. A terminal crimping machine for crimping electrical terminals onto the ends of wires, the resulting crimped connections being required to have a predetermined nominal crimp height plus or minus a predetermined crimp height tolerance, the crimping machine comprising frame means, a ram having movable crimping tooling thereon, a fixed tooling support means on the frame means having fixed tooling thereon, the ram being reciprocable in the frame means in opposite directions of reciprocation towards and away from the fixed tooling thereby to move the movable tooling between a remote position and a proximate position with respect to the fixed tooling, the movable tooling being in a shut height position when the ram is in its proximate position, the shut height position determining the crimp height of the crimped connection, the crimping machine being characterized in that:

a fine adjusting means is provided for moving the fixed tooling support for adjustment purposes in the directions of reciprocation, the fine adjusting means having an adjustment sensitivity which is commensurate with the crimp height tolerance, the frame means has a recess extending therein in the directions of reciprocation of the ram, the fixed tooling support has a support extension which extends into the recess, the fine adjusting means comprises an adjusting screw and wedge means, the adjusting screw having an intermediate unthreaded portion which extends through the recess and having threaded ends which are threaded into the frame means, the wedge block being in the recess, the unthreaded portion extending freely through the wedge block, the adjusting screw and the wedge block having overlapping portions so that rotation of the screw causes movement of the wedge block in opposite directions which extend transversely of the directions of reciprocation, the wedge block and the frame means having complementary inclined surfaces which are against each other and which cause movement of the fixed tooling support means in the directions of reciprocation upon movement of the wedge block thereby to adjust the position of fixed tooling support and the fixed tooling relative to the shut height position of the movable tooling.

7. A terminal crimping machine as set forth in claim 6 characterized in that a coarse adjusting means is provided, the coarse adjusting means having an adjustment sensitivity which is commensurate with the nominal crimp height.

8. A terminal crimping machine as set forth in claim 7 characterized in that the coarse adjusting means adjusts the shut height position of the movable tooling.

9. A terminal crimping machine as set forth in claim 6 characterized in that the wedge block has an opening extending therethrough laterally of the directions of reciprocation, the unthreaded portions of the adjusting screw being in the opening, the threaded portions of the adjusting screw having a diameter which is greater than the width of the opening, the opposed overlapping portions of the adjusting screw and the wedge block being oppositely facing side surface portions of the wedge block and shoulder portions of the adjusting screw which are between the threaded portions of the unthreaded portions.

10. A terminal crimping machine as set forth in claim 9 characterized in that tensioning means are provided on the frame member and the adjusting screw which are effective to place the adjusting screw in tension thereby avoiding backlash in the adjusting screw.

11. A terminal crimping machine as set forth in claim 10 characterized in that the tensioning means comprises a pair of cylindrical sleeves which have internal threads and external threads, the internal threads being in threaded engagement with the threaded portions of the adjusting screw, the external threads being in threaded engagement with threaded openings in the frame means.

* * * * *

UNITED STATES PATENT AND TRADEMARK OFFICE

CERTIFICATE OF CORRECTION

PATENT NO. : 4,970,889

DATED : Nov. 20, 1990

INVENTOR(S) : Howard C. Phillips, et al.

It is certified that error appears in the above-identified patent and that said Letters Patent is hereby corrected as shown below:

The title page, showing the illustrative figure, should be deleted to be replaced with the attached title page.

The sheets of drawings, consisting of Figs. 1 - 8, should be added as shown on the attached pages.

Signed and Sealed this

Twenty-ninth Day of October, 1991

*Attest:*

HARRY F. MANBECK, JR.

*Attesting Officer*

*Commissioner of Patents and Trademarks*

United States Patent [19]

Phillips et al.

[11] Patent Number: 4,970,889

[45] Date of Patent: Nov. 20, 1990

[54] CRIMPING MACHINE HAVING IMPROVED ADJUSTING SYSTEM

[75] Inventors: Howard C. Phillips, Harrisburg; Dallas E. Schlegel, Mechanicsburg, both of Pa.

[73] Assignee: AMP Incorporated, Harrisburg, Pa.

[21] Appl. No.: 351,679

[22] Filed: May 12, 1989

[51] Int. Cl.[5] ..... B21J 13/02

[52] U.S. Cl. ..... 72/446; 72/441; 72/482; 29/748

[58] Field of Search ..... 72/441, 446, 413, 482, 72/472, 234; 29/750, 748

[56] References Cited

U.S. PATENT DOCUMENTS

| | | | |
|---|---|---|---|
| 558,673 | 4/1896 | Colling | 72/413 |
| 2,792,044 | 5/1957 | Strom | 72/413 |
| 3,184,950 | 5/1965 | Sitz | 72/412 |
| 3,948,077 | 4/1976 | Bothe | 72/441 |
| 4,130,005 | 12/1978 | Haines | 72/441 |
| 4,611,484 | 9/1986 | Mac Kissinger, Jr. | 72/481 |
| 4,791,803 | 12/1988 | Broquet et al. | 72/472 |

OTHER PUBLICATIONS

AMP Customer Manual, CM 5128, Dec. 1984, "Basic AMP-O-Lectric Model 'K' Terminating Machine, Accessories, and Modified Machines".

*Primary Examiner*—David Jones

[57] ABSTRACT

Crimping machine comprises a press and a terminal applicator. The applicator ram is coupled to the press ram and has movable crimping tooling adjustably mounted thereon. The fixed crimping tooling is mounted in the applicator frame which in turn is supported on the press platen. A coarse adjusting system is provided on the applicator ram for adjusting the position of the movable crimping tooling on the ram and a fine adjusting system is provided in the press platen for adjusting the position of the applicator frame and thereby adjusting the position of the fixed tooling. The fine adjusting system results in the achievement of crimped connections within more narrow tolerance limits than have heretofore been possible.

11 Claims, 6 Drawings

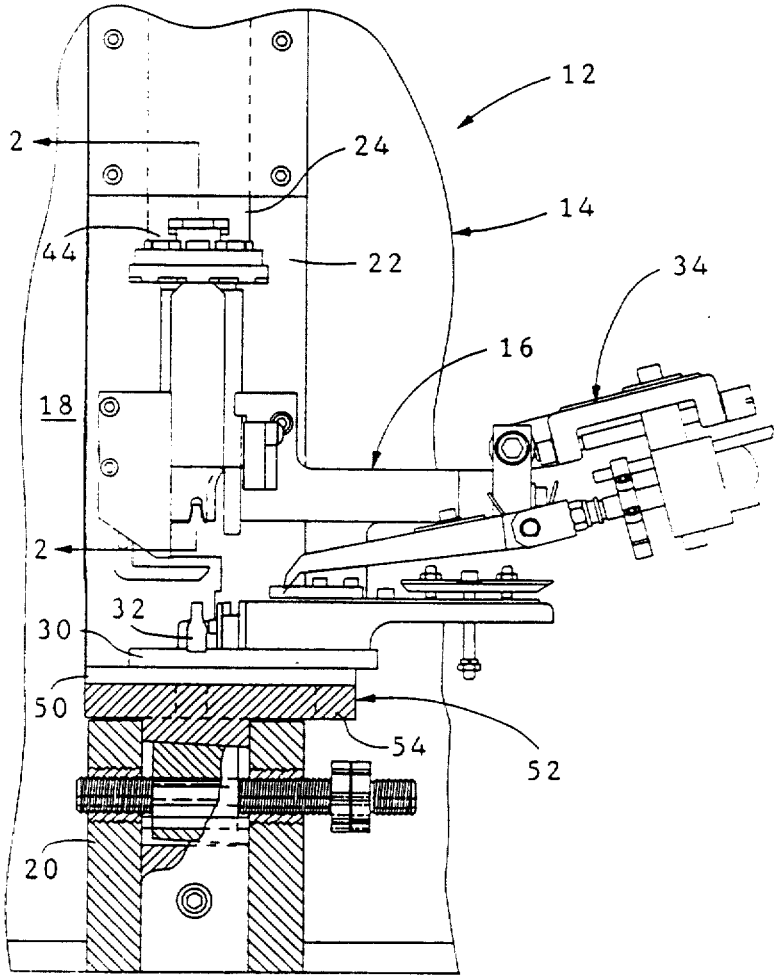

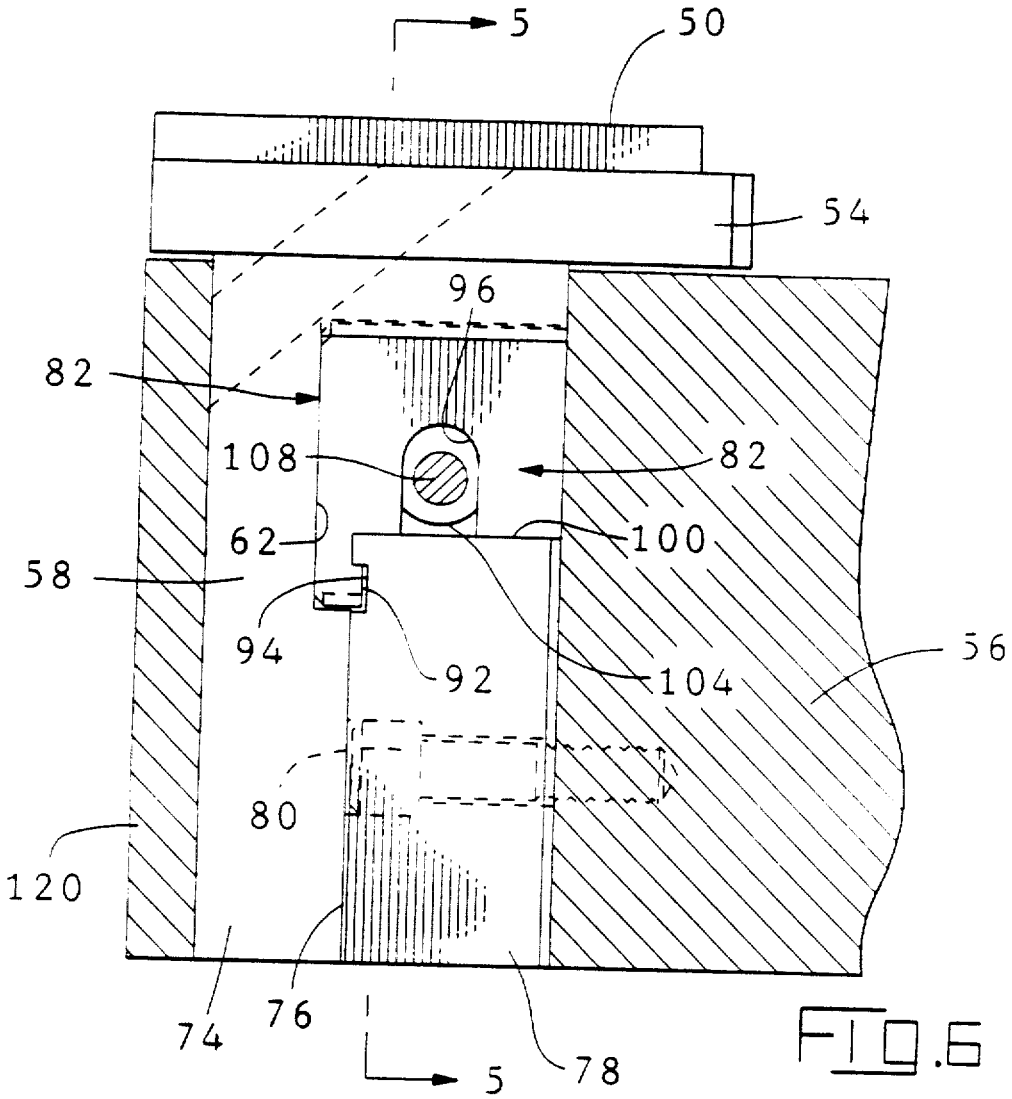
FIG. 6
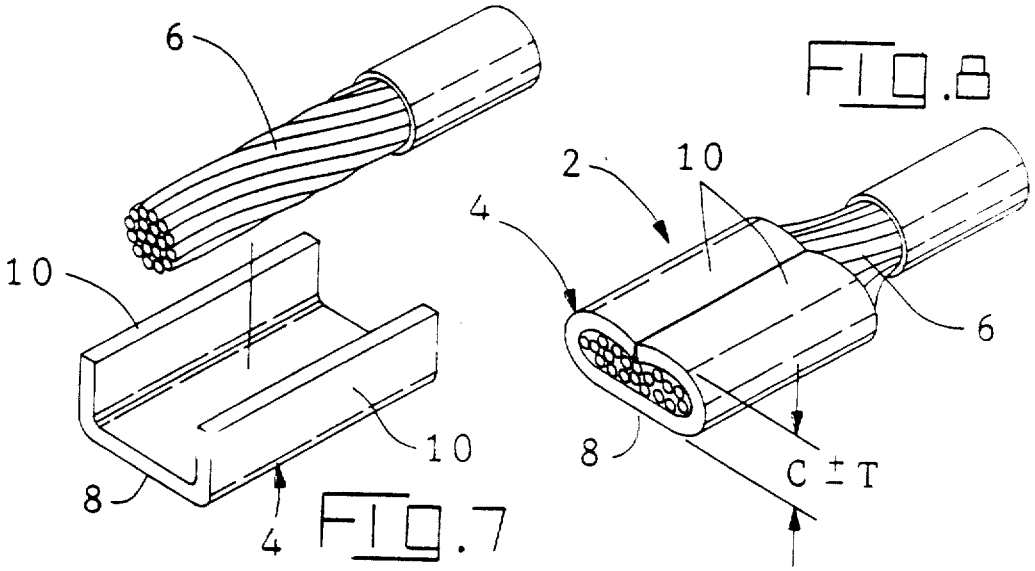
FIG. 7
FIG. 8